US006545402B1

(12) United States Patent
Ko

(10) Patent No.: US 6,545,402 B1
(45) Date of Patent: Apr. 8, 2003

(54) SHADOW MASK HAVING VERTICAL PITCH BETWEEN 2.7 AND 8 TIMES VERTICAL PITCH

(75) Inventor: Sung Woo Ko, Kyonsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/363,048

(22) Filed: Jul. 29, 1999

(30) Foreign Application Priority Data

Jul. 29, 1998 (KR) ..... 98-30605
Feb. 9, 1999 (KR) ..... 99-4510

(51) Int. Cl.[7] ..... H01J 29/07; H01J 29/81
(52) U.S. Cl. ..... 313/403; 313/402; 313/408
(58) Field of Search ..... 313/402, 403, 313/408, 348

(56) References Cited

U.S. PATENT DOCUMENTS

| | | | | | |
|---|---|---|---|---|---|
| 3,973,159 | A | * | 8/1976 | Barten | 313/403 |
| 4,186,320 | A | * | 1/1980 | Hosokoshi | 313/403 |
| 4,210,842 | A | * | 7/1980 | Nakayama et al. | 313/403 |
| 4,271,247 | A | * | 6/1981 | Morrell | 313/403 |
| 4,296,189 | A | * | 10/1981 | Kuzmiuski | 313/403 |
| 4,326,147 | A | * | 4/1982 | Nakayama et al. | 313/403 |
| 4,926,089 | A | | 5/1990 | Moore | 313/403 |
| 4,942,332 | A | | 7/1990 | Adler et al. | 313/402 |
| 5,619,094 | A | * | 4/1997 | Vriens | 313/402 |

FOREIGN PATENT DOCUMENTS

| | | |
|---|---|---|
| JP | 57194437 | 11/1982 |
| JP | 02186536 | 7/1990 |

* cited by examiner

*Primary Examiner*—Michael H. Day
*Assistant Examiner*—Mariceli Santiago
(74) *Attorney, Agent, or Firm*—Birch, Stewart, Kolasch & Birch, LLP

(57) ABSTRACT

There is disclosed a shadow mask for a color braun tube to reduce moire by improving a structure of a beam passage hole on a mask.

According to a first embodiment, in a color braun tube including a mask having many beam passage holes over emitting paths of electron beams, a mask for the color braun tube has a vertical pitch of the beam passage holes that is 2.7 and more times as long as a vertical pitch of horizontal electron beam lines scanned on a screen.

According to a second embodiment, in a color braun tube including a mask having many beam passage holes over emitting paths of electron beams, a mask for the color braun tube has a vertical pitch of the beam passage holes that is 3.4 and more times as long as a vertical pitch of horizontal electron beam lines scanned on a screen.

According to a third embodiment, in a slot mask comprising beam passage holes whose length is shorter than a length of each beam passage hole in a grille mask and longer than a length of each beam passage hole in a dot mask and bridges connected to no-hole portions between the beam passage holes arranged in a vertical direction, a mask for a color braun tube has symmetrical left and right bridges by separating and isolating each of the bridges at its center, each of the left and right bridges covering a part of a fluorescent material including a black matrix.

7 Claims, 8 Drawing Sheets

SHADOW MASK HAVING VERTICAL PITCH BETWEEN 2.7 AND 8 TIMES VERTICAL PITCH

BACKGROUND OF THE INVENTION

1. Field of the Invention

The present invention relates to a color braun tube and more particularly to a shadow mask for sorting colors of electron beams in a color braun tube.

2. Description of Related Art

Typically, a color braun tube, as shown in FIG. 1, comprises a panel 1 coated with an R, G, B fluorescent material 1*a* on the inner surface in a certain pattern and a funnel 2 which is mated with the panel 1 at the edge of the panel 1 and narrowed backward so as to define a neck portion 2*a* shaping like a bottle neck.

Within the panel 1, a mask 3 having a plurality of holes (hereinafter, called beam passage holes), e.g., slits or porosities, is fixed to and supported by a frame 4.

The frame 4 is mated with an inner shield 5 for blocking an external earth magnetic field. The neck portion 2*a* encloses an electron gun 7 for emitting R, G, B electron beams 6. A deflection yoke 8 is provided around the neck portion 2*a* to deflect the electron beams 6 in horizontal and vertical directions.

In such configured color braun tube, once a video signal is supplied to the electron gun 7, the electron beams 6 are emitted from a cathode of the electron gun 7. The emitted electron beams 6 are controlled, accelerated, and focused by different voltages applied to respective electrodes of the electron gun 7. The electron beams 6 are then horizontally and vertically deflected by a static magnetic field of the deflection yoke 8 and pass through beam passage holes 3*a* on the mask 3. The beams passing through the holes 3*a* make the fluorescent material 1*a* on the inner surface of the panel 1 emit light to produce an image. Various types of masks can be properly applied in accordance with characteristics of braun tubes. Representative masks are a grille mask without bridge protrusions, a slot mask having bridge protrusions and vertically elongated circular beam passage holes, and a dot mask having beam passage holes relatively smaller than those of the slot mask.

As shown in FIG. 2, the grille mask 3 has the largest beam passage holes 3*a* compared with other mask types, thereby effecting good luminance. Furthermore, since the grille mask 3 does not include bridge protrusions, a moire phenomenon does not occur.

On the other hand, since occupation rate of beam passage holes 3*a* is higher than that of no-hole portions 3*b* in the mask, the grille mask 3 is vulnerable in strength.

To make up for the weak point, there is disclosed a mask as shown in FIG. 3, wherein a length of each beam passage hole is shortened, shaping like the slot mask type, and bridge protrusion 3*c* named false ties are arranged in a staggered fashion on both inner sides of each beam passage hole across the mask (U.S. Pat. No. 4,926,089).

This mask type enhances the strength of the mask by means of the bridge protrusion 3*c*. However, a size of the bridge protrusion 3*c* is not clearly defined. This may lead to a problem of decrease in luminance.

The above U.S. Patent describes that it is preferable to select a size of the bridge protrusion 3*c* such that a black matrix (BM) or bridge shadow is not visible on the screen to the viewer at a normal viewing distance. There is no specific description on the size of the bridge protrusion 3*c* other than the above description. Therefore, it can be easily noted that the luminance is decreased by an area where the electron beams are blocked by the bridge protrusion 3*c*.

Furthermore, the bridge protrusion 3*c* is formed to supplement the strength of the mask 3, but side effects by the bridge protrusion are not considered.

In addition, it is easily predictable that the bridge protrusion 3*c* needs a sufficient size to make the mask 3 have an enough strength by means of the bridge protrusion 3*c*. In this occasion, the large bridge protrusion 3*c* covers a large area of the fluorescent material 1*a* and more electron beam is blocked, thereby decreasing the luminance.

If the size of the bridge protrusion 3*c* is very small, of course, the above problems do not occur. However, as stated above, the U.S. Pat. No. 4,926,089 is provided to enhance the strength of the mask, so it is reasonable to exclude this case.

Alternatively, the slot mask 3, as shown in FIG. 4, has beam passage holes 3*a* smaller than those in the grille mask bridge protrusions 3*d* connected to no-hole portions 3*b* are provided between beam passage holes linearly arranged in a vertical direction.

Compared with the grille mask, the slot mask decreases in luminance because the quantity of transmitting beams is decreased. Moreover, the bridge protrusions 3*d* causes the moire phenomenon in the slot mask.

The moire phenomenon is not avoidable in masks having bridge protrusions. The moire phenomenon means that portions emitting light by means of electron beams and portions shaded by bridge protrusions 3*d* alternately and periodically appear on a screen. The moire phenomenon produces fringes in an image displayed on the screen.

Such moire is sufficiently influenced by a vertical pitch (vp) of beam passage holes 3*a* in the slot mask 3.

At this time, it should be considered that the vertical pitch (vp) of beam passage holes 3*a* must be designed to be kept at an appropriate level to maintain a desirable strength of the mask 3. Besides, each bridge protrusion 3*d* should have an appropriate size to manage mechanical characteristics such as external impulse and howl.

The above facts limit the extension of vertical pitch (vp). The limitation of the vertical pitch (vp) extension causes an amount of the electron beams 6 to be blocked, decreasing an area of the fluorescent material 1*a* emitting the light. This results in reduction of luminance and makes the moire phenomenon more serious.

FIG. 5 is a graph showing a functional relation between a vertical distance of the mask and a strength of the electron beam scanned in the vertical direction. The data values in FIG. 5 are obtained from simulation.

According to the graph, points are irregularly located on a curved line, showing luminance distribution of long wavelengths. This means that the moire is visually recognizable.

In other words, each point depicted in the graph represents moire appearing on the screen. The points located along the curved line other than points corresponding to the turning points from decrease to increase represent the moire produced by other causes than shadow of bridge protrusions 3*d*. This kind of moire occurs when a value of the pitch of beam passage holes 3*a* is small. Therefore, the pitch of beam passage holes 3*a* should be lengthened to reduce the moire.

SUMMARY OF THE INVENTION

Accordingly, the present invention is directed to a shadow mask for a color braun tube that substantially obviates one or more of the limitations and disadvantages of the related art.

An objective of the present invention is to provide a shadow mask for reducing or preventing moire by improving a structure of a mask for a color braun tube.

Additional features and advantages of the invention will be set forth in the following description, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a first embodiment is provided. According to the first embodiment, in a color braun tube including a mask having many beam passage holes over emitting paths of electron beams, a mask for the color braun tube has a vertical pitch of the beam passage holes that is 2.7 and more times as long as a vertical pitch of horizontal electron beam lines scanned on a screen.

According to a second embodiment, in a color braun tube including a mask having many beam passage holes over emitting paths of electron beams, a mask for the color braun tube has a vertical pitch of the beam passage holes that is 3.4 and more times as long as a vertical pitch of horizontal electron beam lines scanned on a screen.

According to a third embodiment, in a slot mask comprising beam passage holes whose length is shorter than a length of each beam passage hole in a grille mask and longer than a length of each beam passage hole in a dot mask and bridge protrusions connected to no-hole portions between the beam passage holes arranged in a vertical direction, a mask for a color braun tube has symmetrical left and right bridge protrusions by separating and isolating each of the bridge protrusions at its center, each of the left and right bridge protrusions covering a part of a fluorescent material including a black matrix.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

With reference to FIGS. 6 to 11, the present invention will now be described.

Figure 6:
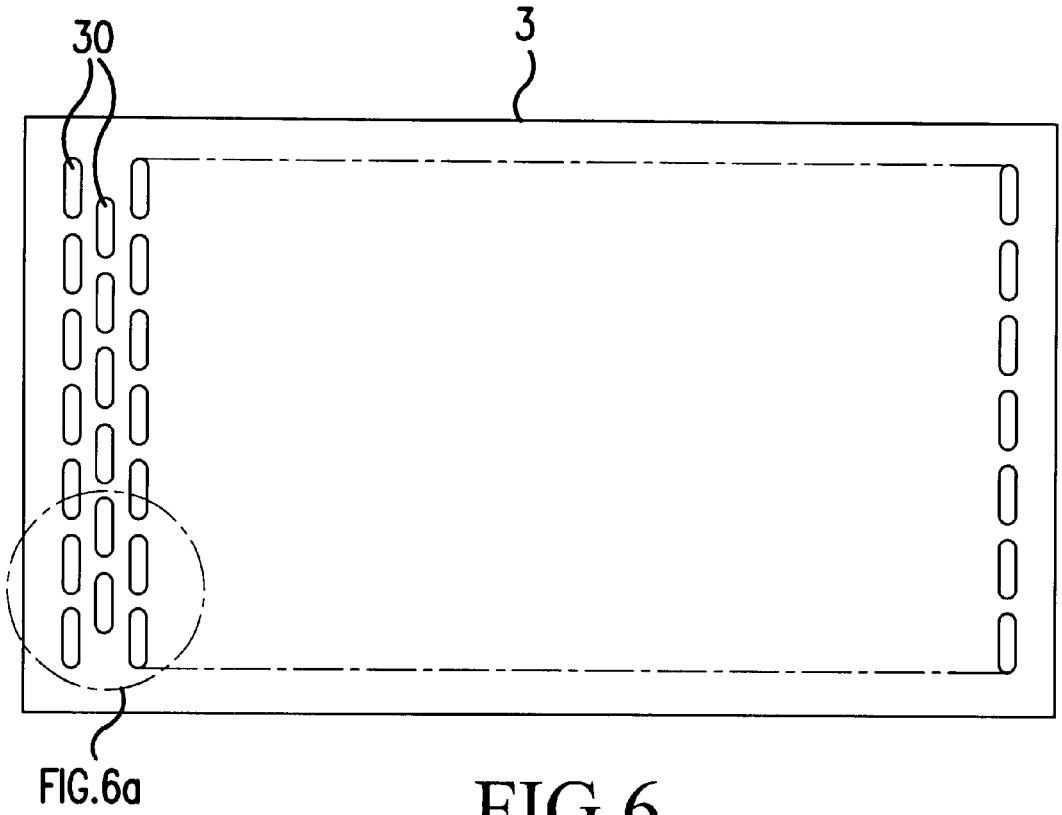
FIG. 6 shows an embodiment of a mask according to the present invention.
Figure 6A:
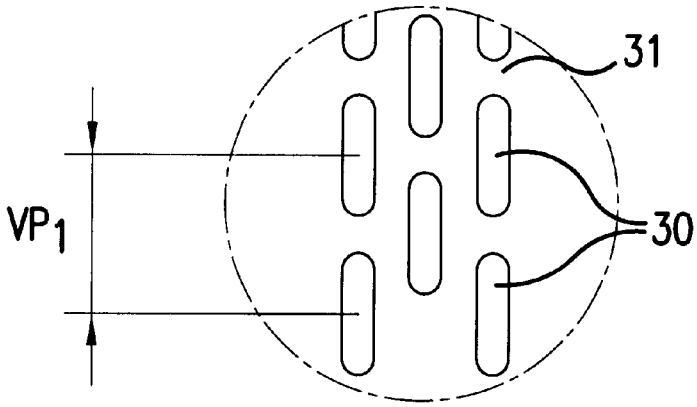

FIG. 6 shows a first embodiment of the present invention. In a slot mask having beam passage holes of a size obtained through compromise between sizes of respective beam passage holes of grille and dot masks, a vertical pitch, $vp_1$, of beam passage holes 30 is extended by a predetermined length in a vertical direction based upon a proportional function between the $vp_1$ and a vertical pitch, $vp_2$, of horizontal electron beam lines scanned on a screen on an inner surface of a panel 1.

The extended vertical pitch, $vp_1$, of the beam passage holes 30 allows not only a mask 3 to have an appropriate strength but also increase of the quantity of electron beams 6 passing through the mask 3, thereby improving luminance while reducing moire.

However, even if the luminance is improved, the moire may not be reduced, so limit conditions are required.

Figure 7:
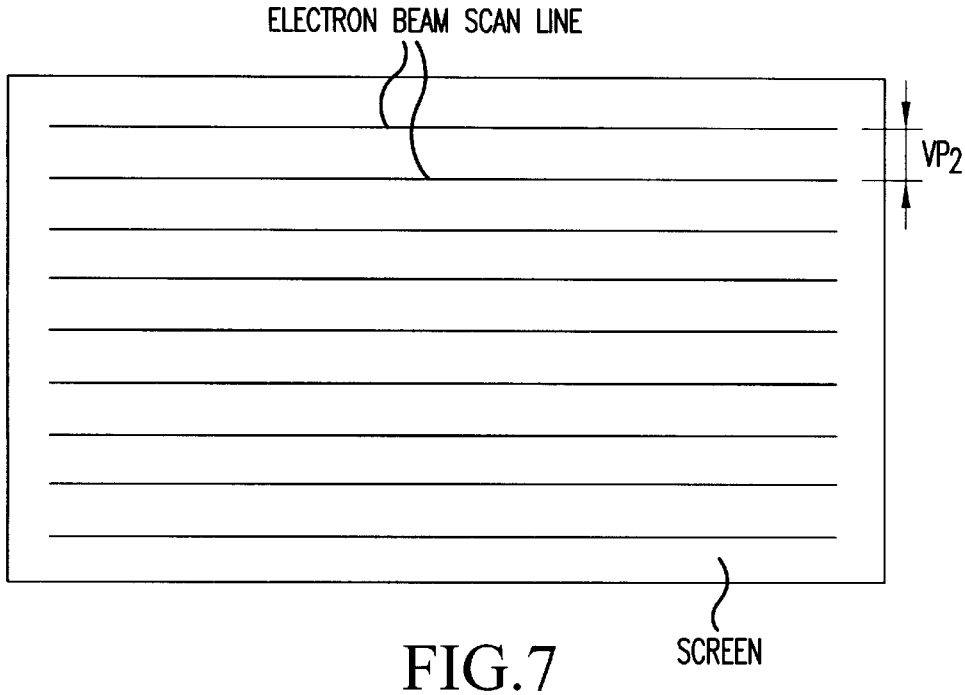
FIG. 7 shows horizontal electron beam lines scanned on a screen.

In other words, as shown in FIG. 7, the electron beams 6 scanned on the screen and arrangement of bridge protrusions 31 on the mask 3 have a periodicity, so the electron beam lines and bridge protrusions overlap each other, causing interference. This phenomenon has caused the moire. Therefore, to prevent such interference, the condition, vertical pitch of mask≧(height of screen/number of scanned electron beams)×constant (A), should be satisfied.

At this occasion, the constant is a relational constant used for preventing the interference between the period of electron beams scanned on the screen and the period of the bridge protrusion arranged on the mask. The interference between the two periods can be considerably reduced when a value of the constant is 2.7.

Figure 8:
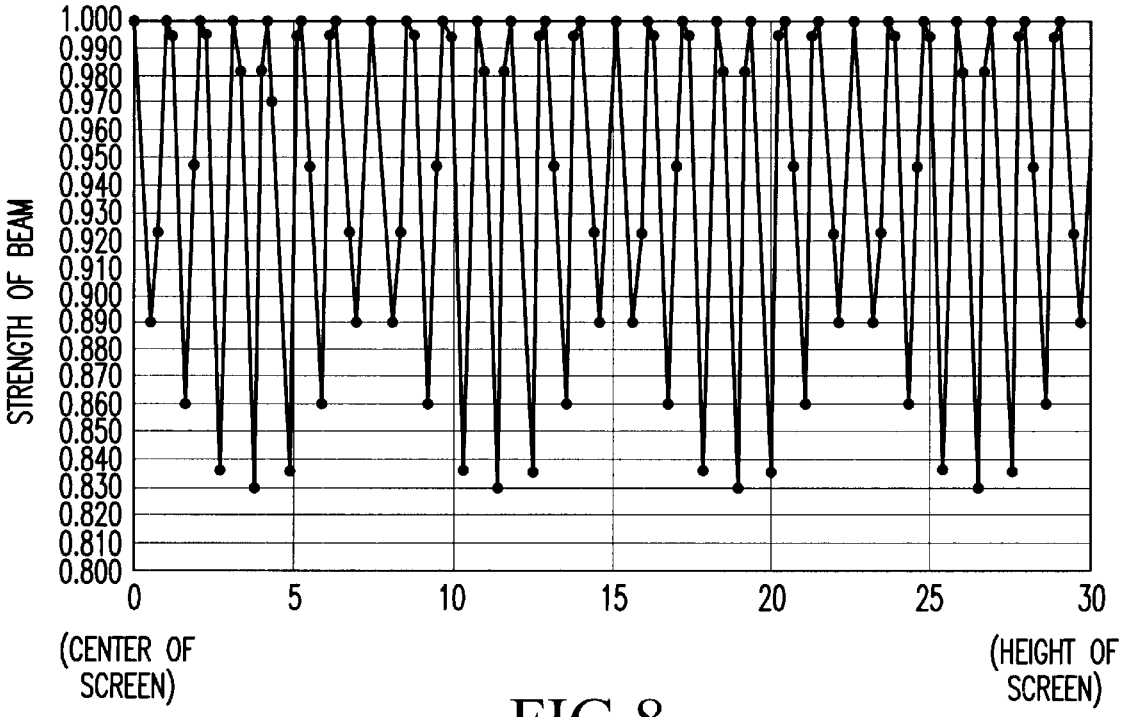
FIG. 8 is a graph showing an example of the reduction of moire by increasing a vertical pitch of beam passage holes to 2.7 times a vertical pitch of horizontal electron beam lines.
Figure 9:
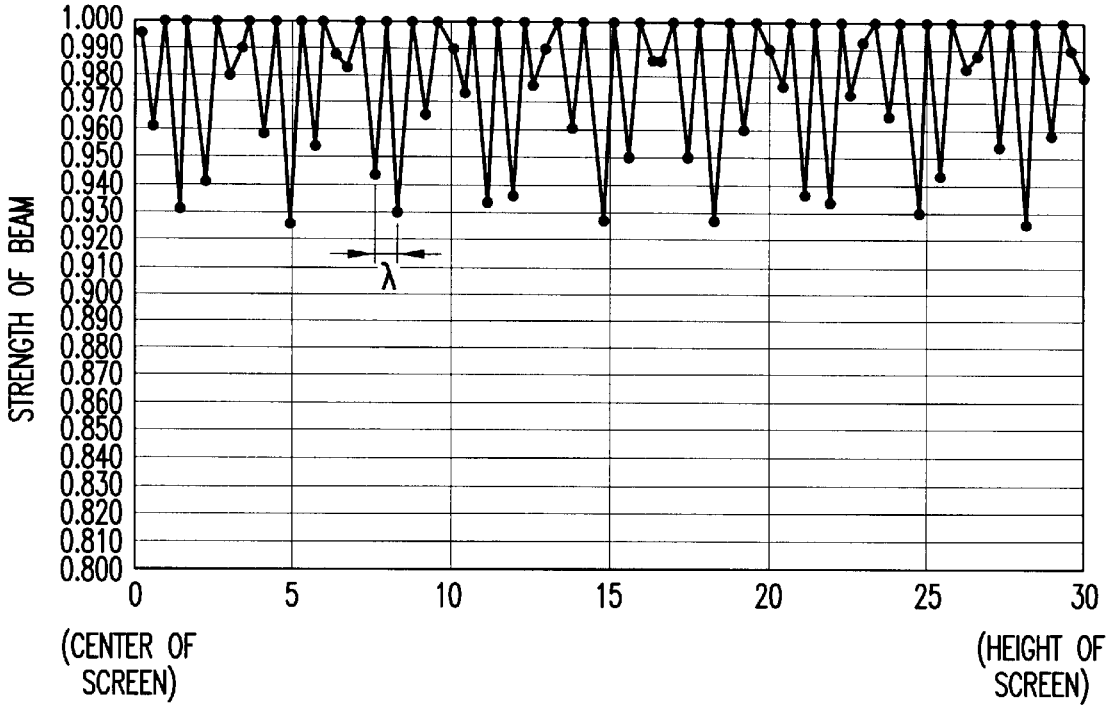
FIG. 9 is a graph showing an example of a case that moire is reduced or removed by increasing a vertical pitch of beam passage holes to 3.4 times a vertical pitch of horizontal electron beam lines.

When the vertical pitch, $vp_1$, of beam passage holes 30 on the mask is about 2.7 or more times the vertical pitch, $vp_2$, of horizontal electron beam lines scanned on the screen, the moire is considerably reduced as shown in FIG. 8. When the vertical pitch, $vp_1$, of beam passage holes 30 is about 3.4 or more times the vertical pitch, $vp_2$, of horizontal electron beam lines scanned on the screen, the moire is completely removed as shown in FIG. 9. If the vertical pitch, $vp_1$, is smaller than the limit value in each case, the moire increases.

Figure 1:
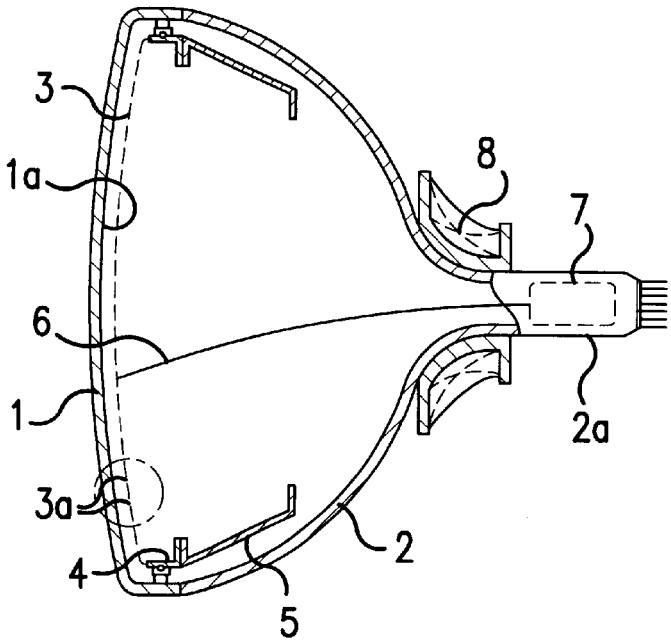
FIG.1 RELATED ART
FIG. 1 is a sectional elevation view of a conventional color braun tube.
Figure 2:
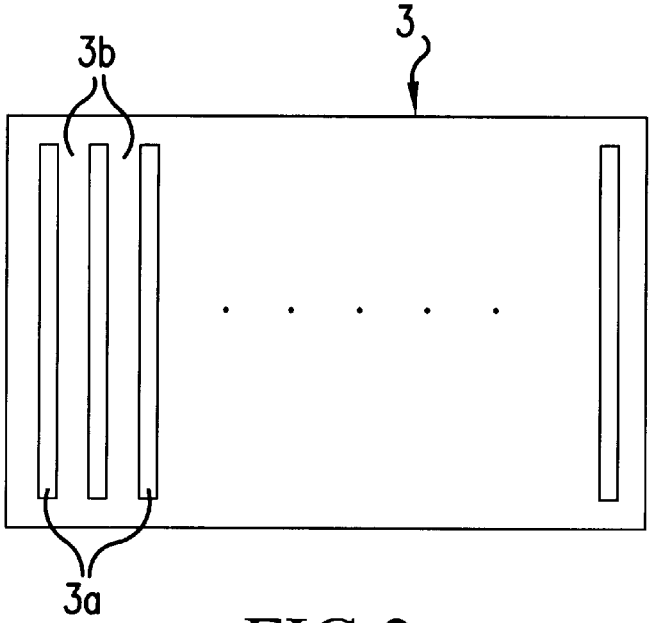
FIG.2 RELATED ART
FIG. 2 is a front view of a grille mask.
Figure 3:
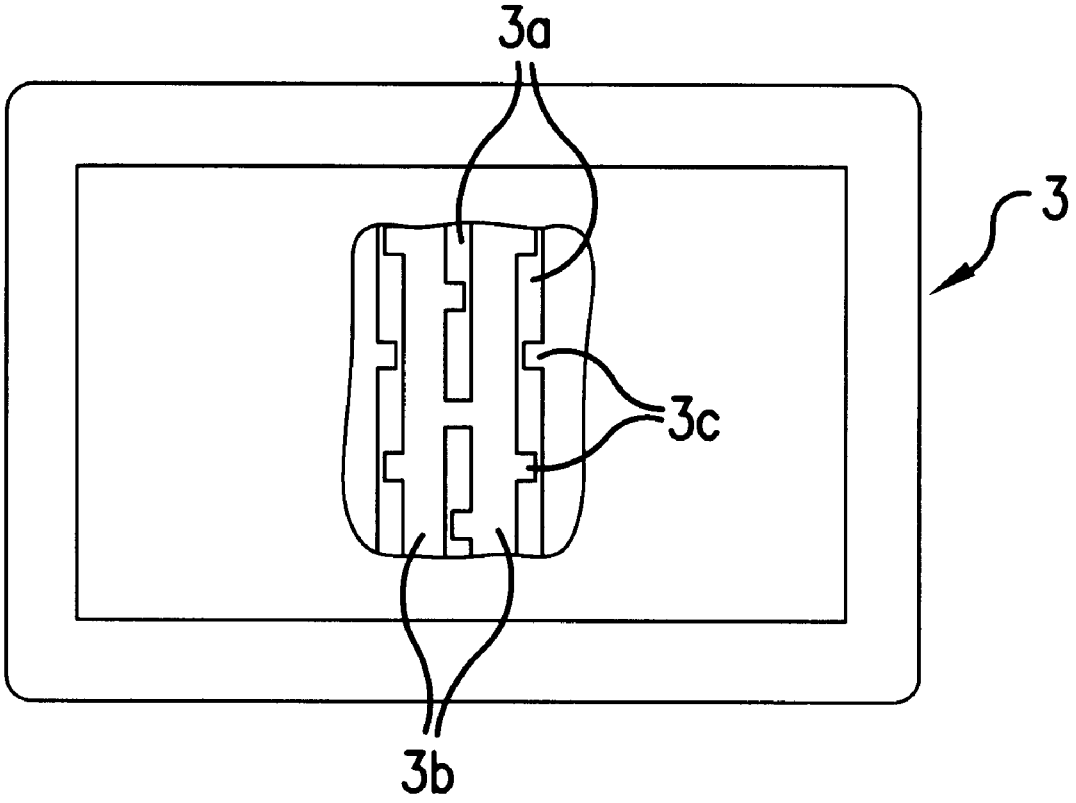
FIG.3 RELATED ART
FIG. 3 is a front view of a conventional slot mask with false ties.
Figure 4:
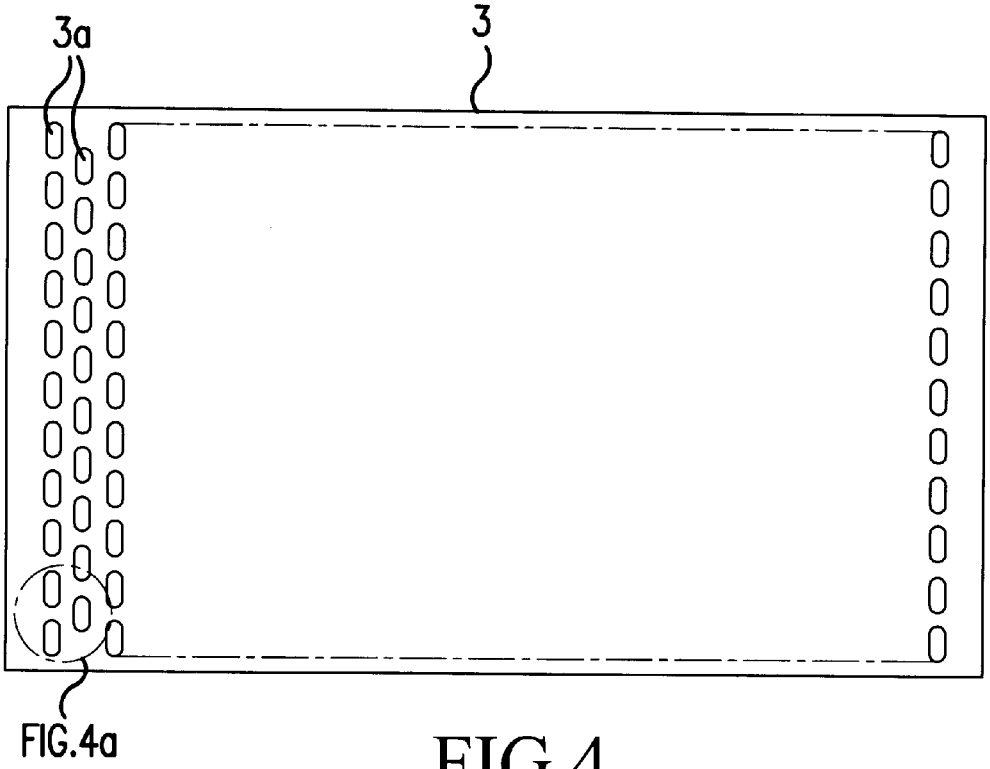
FIG.4 RELATED ART
FIG. 4 is a front view of a conventional slot mask.
Figure 4A:
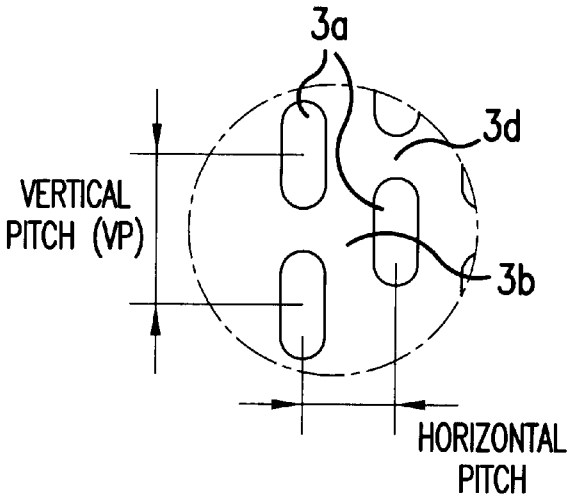
FIG.4a RELATED ART
Figure 5:
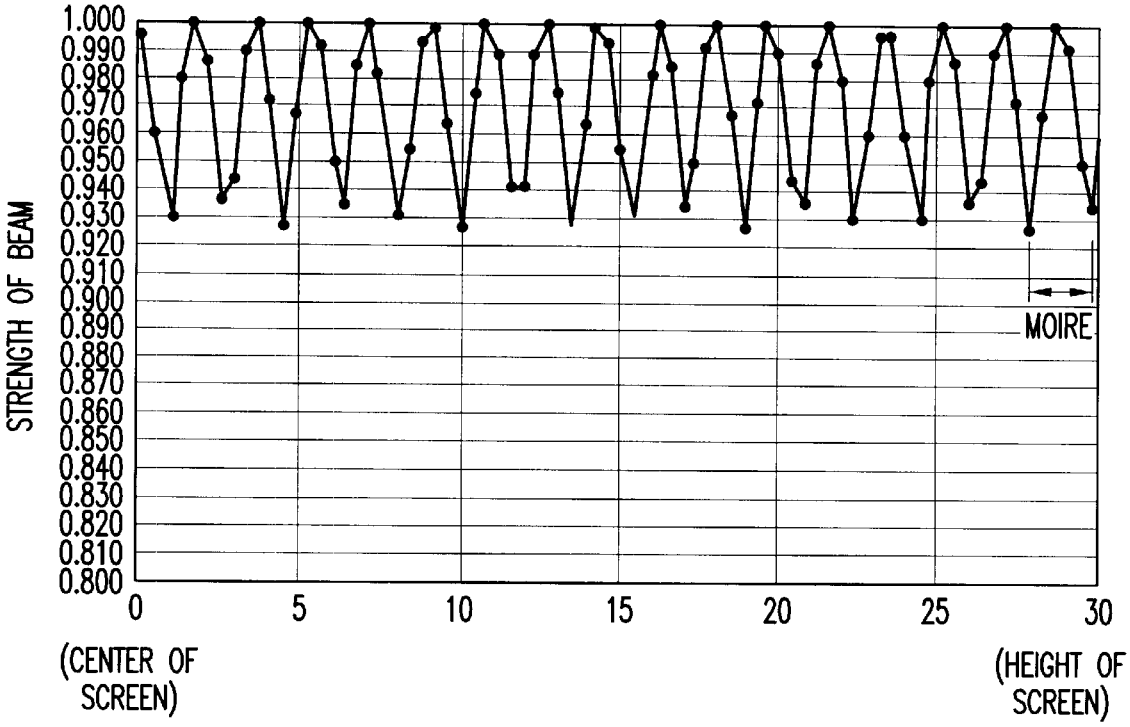
FIG.5 RELATED ART
FIG. 5 is a graph showing a functional relation between a vertical distance of a mask and a strength of electron beams scanned in a vertical direction.

In the above graphs, an important fact representing the reduction of moire is an area of each periodic wave (the area of triangle). Actually, comparing FIG. 8 with FIG. 5, it is notable that the area of each periodic wave in FIG. 8 is smaller than in FIG. 5.

This vertical pitch of beam passage holes 30 can be applied to a cathode display tube (CDT) and a cathode picture tube (CPT) in common.

As illustrated, the present invention extends the vertical pitch, $vp_1$, of beam passage holes 30 on the mask 3 to an appropriate size to increase the quantity of electron beams 6 passing through the mask 3, thereby not only enhancing the luminance but also considerably reducing the moire interfering with improvement of picture quality in the braun tube.

At this time, the size of the vertical pitch, $vp_1$, of beam passage holes 30 is determined in accordance with the following condition.

A distance (hereinafter, called a vertical scan pitch, $vp_2$) between electron beam lines that are scanned on the screen of the panel 1, making parallel horizontal lines at regular intervals, depends on a vertical scan mode applied to the braun tube.

The vertical scan mode is applied to the CDT usually employed as a monitor in various types such as 640×480, 800×600, 1024×768, 1280×1024, 1600×1200, etc. Each latter numeral in the various mode types indicates the number of electron beam lines scanned in the vertical direction. A pitch of these electron beam lines is called the vertical scan pitch, $vp_2$ (see FIG. 7).

An interference period, λ, between the vertical scan pitch, $vp_2$, and the vertical pitch, $vp_1$, of beam passage holes is expressed as $\lambda=|(n/S)-(2m/Pv)|^{-1}$.

In the above formula, "S" indicates the vertical scan pitch, $vp_2$, of electron beams, "Pv" indicates the vertical pitch, $vp_1$, of beam passage holes 30, and "n" and "m" indicate integers representing respective periods of sin and cos obtained through fourier series of the electron beams scanned on the screen and a transmittance function of the mask.

In this case, a strength of electron beams scanned on the screen has somewhat a sin pattern. On the other hand, the transmittance of the mask 3 has an on/off pattern like digital signals. Accordingly, if the vertical pitch, $vp_1$, of beam passage holes 30 becomes larger without limit, only shadow of bridge protrusions appears as the interference between the electron scan beams and bridge protrusions 31. In this occasion, if the size of each bridge protrusion is reduced, even the shadow of the bridge protrusions does not appear, thereby improving the luminance and reducing the moire.

As the vertical pitch of the mask is extended to 2 through 5 times the vertical pitch of a usual mask, the luminance becomes proportionally improved more and more. If structuring beam passage holes (generally, of stripe type) without bridge protrusions as the most ideal form, the luminance reaches 100% and the moire does not occur at all.

The present invention relates to the mask 3 having bridge protrusions 31. To ideally reduce the moire under the condition of existence of bridge protrusions, either the vertical pitch, $vp_2$, of horizontal electron beam lines scanned on the screen or the vertical pitch, $vp_1$, of beam passage holes should be outstandingly longer than the other.

Namely, the condition, vertical pitch of mask≧(height of screen/number of scanned electron beams)×A, should be satisfied.

It was noted that the moire is considerably reduced when the relational constant A used for preventing the interference between two periodic waves is 2.7 and more. When the value of A is 3.4 and more, it is possible to obtain the most ideal picture with no moire.

If the vertical pitch, $vp_1$, of beam passage holes 3 is extended to an appropriate length as described above, graphs like FIG. 8 and FIG. 9 are obtained. Particularly, according to FIG. 9, points appear only at the inverted parts on the subsequent line. This means that only the shadow of bridge protrusions is shown on the screen and the moire does not occur at all.

Here, the shadow of each bridge protrusion is expressed as λ that is a space between lowest points of the periodic waves on the graph.

Figure 10:
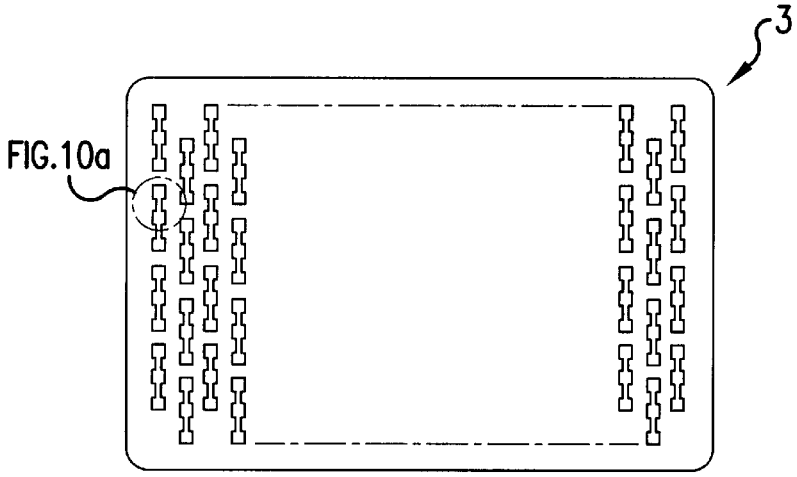
FIG. 10 shows another embodiment of a mask according to the present invention.
Figure 10A:
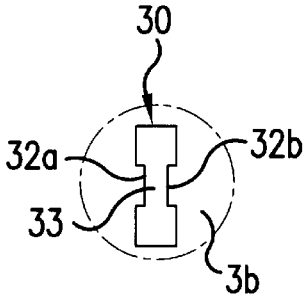
Figure 11:
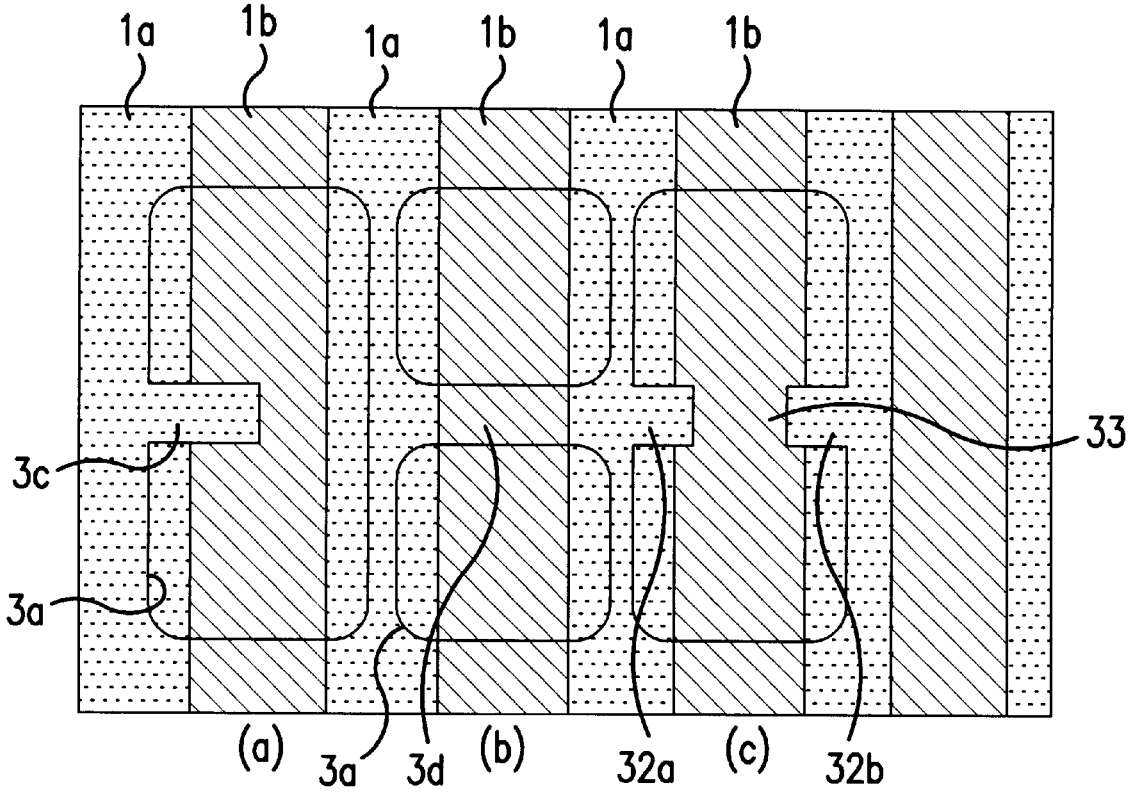
FIG. 11 is a diagram for comparing a slot mask according to the present invention with a conventional slot mask.

Meanwhile, as shown in FIG. 10 and FIG. 11, in a second embodiment of the slot mask according to the present invention for reducing the moire, a bridge protrusion connected with a no-hole portion 3*b* is formed at a center portion of each beam passage hole 30 arranged in the vertical direction and an isolator 33 is formed at the center of the bridge protrusion.

Accordingly, the bridge protrusion is divided into symmetrical left and right bridge protrusions 32*a* and 32*b* around the isolator 33.

At this time, the left and right bridge protrusions 32*a* and 32*b* are placed to cover a part of the fluorescent material 1*a* including a black matrix 1*b* spread on the inner surface of the panel 1.

Particularly, an area of the left bridge protrusion 32*a* or right bridge protrusion 32*b* is designed to be 20~80% of an area consisting of the two left and right bridge protrusions 32*a* and 32*b* and the isolator 33 therebetween.

The reason of limiting the area of each bridge protrusion 32*a*, 32*b* is that the moire increases even if the quantity of transmitting electron beams increases, improving the luminance, when the area of each bridge protrusion is smaller than the minimum limit and that the luminance decreases with increase of the moire when the area of each bridge protrusion exceeds the maximum limit.

In other words, the mask 3 is configured such that the center of the bridge protrusion formed at the center of the beam passage hole 30 of a slot type is opened enough to allow the divided left and right bridge protrusions 32*a* and 32*b* to cover a part of the fluorescent material 1*a* including the black matrix 1*b* spread on the inner surface of the panel 1 in the second embodiment of the present invention.

If each of the left and right bridge protrusions 32*a* and 32*b* covers only the black matrix 1*b* region, this mask pattern is not particularly distinguished from the pattern without the left and right bridge protrusions 32*a* and 32*b*. By making the left and right bridge protrusions 32*a* and 32*b* cover a little part of the fluorescent material 1*a*, the quantity of transmitting electron beams is limited with the covered portion of the fluorescent material 1*a*, thereby proportionally decreasing the luminance.

In this case, the area of the left or right bridge protrusion 32*a*, 32*b* should be properly limited. As stated above, the limit should be within the range of about 20~80% of the area consisting of the left and right bridge protrusions 32*a* and 32*b* and the isolator 33 therebetween.

If the area is smaller than the limit, the moire occurs although the luminance is improved with increase of the quantity of transmitting electron beams. If the area exceeds the limit, the luminance decreases more than needed and the moire also increases.

If the area of each bridge protrusion 32*a*, 32*b* is determined within the limit range, each bridge protrusion 32*a*, 32*b* shades the part of the fluorescent material 1*a*. As a result, the luminance decreases in proportional to shaded area. The proper decrease of the luminance makes an optical illusion, thereby effecting such as the moire phenomenon is not visually recognizable.

Besides, the left and right bridge protrusions 32*a* and 32*b* supplement the strength of the mask, thereby preventing the mask from being torn when mating the mask with a rail and preventing decrease of color purity caused by thermal deformation after the mating.

FIG. 11 comparably illustrates the states that the respective beam passage holes of the conventional slot mask and the slot mask according to the present invention are placed against the fluorescent material 1*a* and black matrix 1*b*. Reference (a) in FIG. 11 shows the U.S. Patent where a bridge protrusion 3*c* is formed at one side of a beam passage hole 3*a*. In this case, an area of the fluorescent material 1*a* shaded by the bridge protrusion 3*c* is relatively large, thereby decreasing the luminance and generating the moire.

Reference (b) shows a connected bridge protrusion 3*d* causing worse luminance than in the case (a) with occurrence of the moire.

On the other hand, a pattern shown in reference (c) has left and right bridge protrusions 32*a* and 32*b* properly shading the fluorescent material 1*a*, thereby properly decreasing the luminance, effecting the optical illusion of decrease in moire.

As illustrated above, the present invention properly extends the vertical pitch of beam passage holes or forming an bridge protrusion at the center of each beam passage hole, thereby effecting decrease of the moire and improvement of the picture quality.

a. It will be apparent to those skilled in the art that various modifications and variations can be made in a shadow mask for a color braun tube of the present invention without deviating from the spirit or scope of the invention. Thus, it is intended that the present invention covers the modifications and variations of this invention provided they come within the scope of the appended claims and their equivalents.

What is claimed is:

1. In a color braun tube including a tension mask assembly having many beam passage holes over emitting paths of electron beams, a mask for the mask assembly of the color braun tube, having a vertical pitch of said beam passage holes that is at least 2.7 times as long as a vertical pitch of horizontal electron beam lines scanned on a screen during a vertical scan.

2. In the color braun tube of claim 1, wherein the mask has a vertical pitch of said beam passage holes that is at least 3.4 times as long as the vertical pitch of horizontal electron beam lines scanned on the screen.

3. A mask structure superimposed over a screen of a color braun tube, said screen having color regions of fluorescent material and black matrix regions, the mask structure comprising:

a plurality of elongated and spaced slots formed in the mask defining open areas, and connected by solid regions between the slots; and bridge protrusions extending from said solid regions symmetrically disposed with respect to a longitudinal axis of each associated slot, such that the protrusions oppose each other defining gaps therebetween restricting the open areas of the slots, said bridge protrusions covering a part of a fluorescent material including a black matrix.

4. The mask structure of claim 3 wherein the area of each bridge protrusion is about 20–80% of a total area of all bridge protrusions and said gaps therebetween.

5. The mask structure of claim 4 wherein said slots have a vertical pitch that is at least 2.7 as long as a vertical pitch of horizontal election beam lines scanned on the screen during a vertical scan.

6. The mask structure of claim 5 wherein the pitch of the slots is at least 3.4 times the pitch of said lines.

7. In a color braun tube including a flat tension mask assembly having many beam passage holes over emitting paths of electron beams, a mask for the mask assembly of the color braun tube, having a vertical pitch of said beam passage holes that is at least 2.7 times and less than 8 times as long as a vertical pitch of horizontal electron beam lines scanned on a screen during a vertical scan.

* * * * *